US006225585B1

(12) United States Patent
Türkmen

(10) Patent No.: US 6,225,585 B1
(45) Date of Patent: May 1, 2001

(54) MOVABLE SWITCH CONTACT ARRANGEMENT HAVING A CONTACT LEVER HOLDER WITH A CONTACT LEVER

(75) Inventor: Sezai Türkmen, Berlin (DE)

(73) Assignee: Siemens AG, Munich (DE)

( * ) Notice: Subject to any disclaimer, the term of this patent is extended or adjusted under 35 U.S.C. 154(b) by 0 days.

(21) Appl. No.: 09/254,192

(22) PCT Filed: Aug. 28, 1997

(86) PCT No.: PCT/DE97/01957

§ 371 Date: Dec. 29, 1999

§ 102(e) Date: Dec. 29, 1999

(87) PCT Pub. No.: WO98/09306

PCT Pub. Date: Mar. 5, 1998

(30) Foreign Application Priority Data

Aug. 28, 1996 (DE) ..... 296 15 566 U

(51) Int. Cl.[7] ..... H01H 3/04

(52) U.S. Cl. ..... 200/335; 335/16

(58) Field of Search ..... 200/244, 256, 200/271, 401, 254; 335/16, 147, 195; 218/22

(56) References Cited

U.S. PATENT DOCUMENTS 4,719,325 1/1988 Kroll et al. .

FOREIGN PATENT DOCUMENTS 35 39 786 5/1987 (DE) .
295 03 327 U 4/1995 (DE) .
222 685 5/1987 (EP) .

*Primary Examiner*—Lincoln Donovan
*Assistant Examiner*—Nhung Nguyen
(74) *Attorney, Agent, or Firm*—Kenyon & Kenyon

(57) ABSTRACT

A movable switch contact arrangement for a low-voltage circuit breaker has a contact lever holder for holding a plurality of contact levers. The contact lever holder includes a base body and additional bodies attachable thereto, as well as external mounting arms for rotatable mounting to open and close the circuit breaker. Contact lever holders of different widths can be produced by combining the base body with additional bodies of different types in order to adapt the circuit breaker to a desired rated current.

4 Claims, 2 Drawing Sheets

MOVABLE SWITCH CONTACT ARRANGEMENT HAVING A CONTACT LEVER HOLDER WITH A CONTACT LEVER

FIELD OF THE INVENTION

The present invention relates to a movable switch contact arrangement for a low-voltage circuit breaker having contact levers and a contact lever holder, rotatably mounted using lateral mounting arms for opening and closing the switch, which holds a contact lever.

BACKGROUND INFORMATION

A switch contact arrangement of this type is described in German Patent Application No.35 39 786 1. The mounting arms are components of a mounting bracket dimensionally matched with a holding body for the contact levers. While this is a construction containing only metallic parts, switching contact arrangements, composed of a combination of molded plastic parts and metallic parts, are also known. In either case, these switch contact arrangements are dimensioned for a given number of contact levers. Therefore, for a series of low voltage circuit breakers including a plurality of rated currents, an equal number of different movable switch contact arrangements would be required.

SUMMARY OF THE INVENTION

An object of the present invention is to reduce the manufacturing cost for this plurality of switch contact arrangements.

According to the present invention, this object is achieved by the fact that the contact lever holder has a central part made up of a base body and at least one additional body attachable thereto, and the mounting arms are attached on both sides of the central part.

Thus two components can be uniformly used for all switch contact arrangements of a series of circuit breakers, e.g., the mounting arms and the base body. Only the additional bodies must be provided according to the width of the central body, which depends on the number of contact levers. A dimensionally appropriate assembly of the central part from its components can be facilitated by the fact that the base body and the additional body or bodies have connecting surfaces provided with projections and matching recesses. Thus the base body and the additional body or bodies can be assembled like building blocks prior to being permanently attached using connecting bolts.

The base body can have at least two threaded holes on each side, while the mounting arms and the additional bodies have through holes for connecting bolts, flush with the threaded holes. Therefore, the additional bodies only have to have through holes, which do not require high accuracy. This facilitates manufacturing of the additional bodies as cost-effective components.

DETAILED DESCRIPTION

Figure 1:
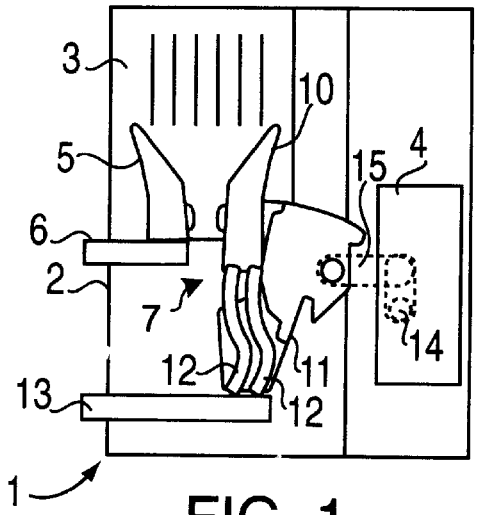
FIG. 1 shows a section of a low-voltage circuit breaker with a movable switch contact arrangement according to an embodiment of the present invention.

A low-voltage circuit breaker 1 schematically shown in FIG. 1 has a housing 2, on which a switch contact system, an arc quenching chamber 3, and a drive device 4 for actuating the switch contact system are mounted. A stationary switch contact 5, connected to an upper connecting bar 6, is part of the switch contact system. A movable switch contact arrangement 7, which interacts with stationary switch contact 5, includes contact levers 10, which are articulatedly mounted on a contact lever holder 11. Flexible conductors 12 are used to connect contact levers 10 with a lower connecting bar 13, arranged parallel to upper connecting bar 6. Both connecting bars 6 and 13 protrude from housing 2 at its rear side and are used to connect circuit breaker 1 to a load circuit.

A switching shaft 14, connected to contact lever holder 11 via an articulated coupling gear 15, is part of drive device 4. Circuit breaker 1 may have a plurality of switch contact systems of the type shown in a parallel arrangement. All poles can be switched on and off using the same drive device 4 and switching shaft 14.

Figure 2:
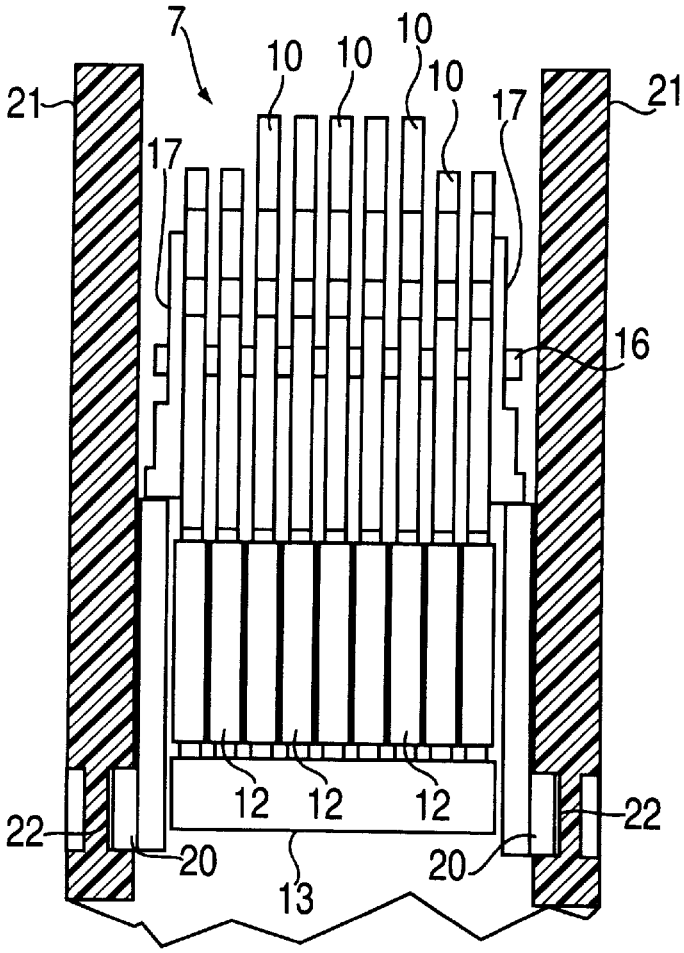
FIG. 2 shows a switch contact arrangement viewed from the contacting sides of the contact levers.

Each movable switch contact arrangement 7 may have a plurality of contact levers 10, as shown in FIG. 2. Contact levers 10 are articulatedly attached to contact lever holder 11, in a known manner using mounting bolt 16 and prestressed in the direction of stationary switch contact 5 using contact springs, which engage with contact levers 10 on the rear and are therefore not visible in FIG. 2.

Contact lever holder 11 has two lateral mounting arms 17, on whose lower ends mounting pins 20 are provided. Wall bodies 21 of housing 2 of circuit breaker 1 are provided with mounting holes 22 for engaging mounting pins 20.

With given mechanical and electrical properties of the individual contact levers 10, the rated current of the movable switch contact arrangement 7 shown depends on the number of contact levers 10. Therefore switch contact systems for different rated currents can be produced using a larger or smaller number of identical contact levers. In the following we shall explain how contact lever holder 11 can be adapted to varying numbers of contact levers 10.

Figure 3:
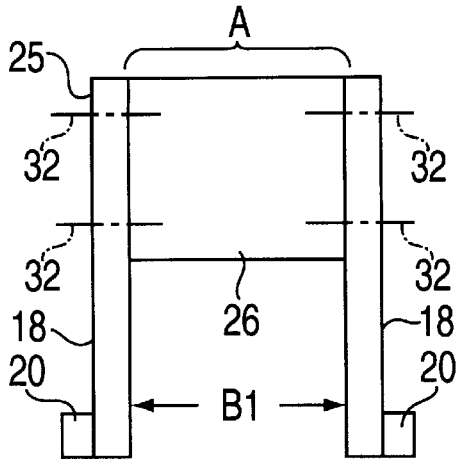
FIG. 3 shows a contact lever holder with a central part having only one base body.
Figure 4:
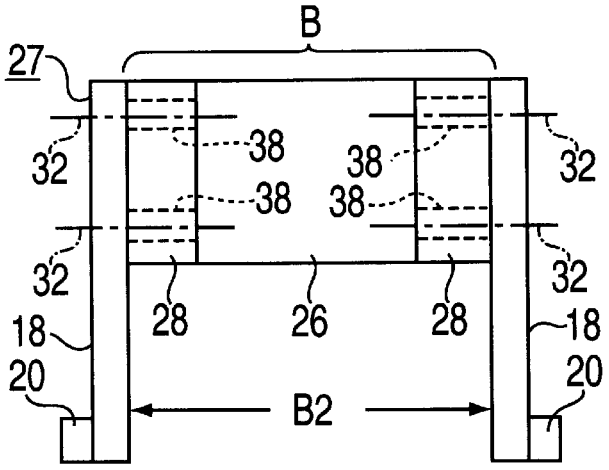
FIG. 4 shows a contact lever holder like that of FIG. 3, with a wider central part having a base body and two additional bodies of a first type.
Figure 5:
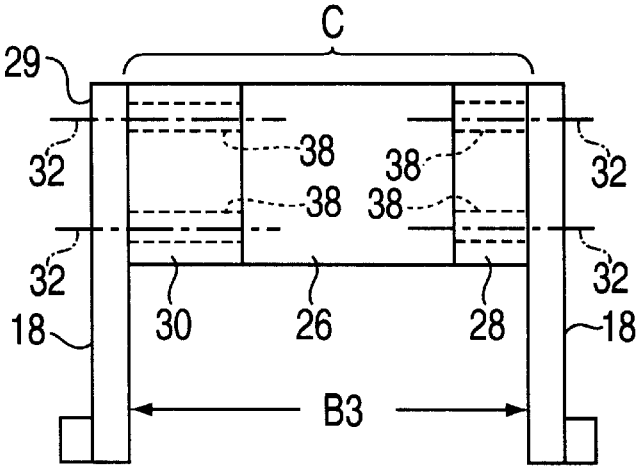
FIG. 5 shows another exemplary embodiment according to the present invention of a contact lever holder, whose central part has one base body and one additional body of a first type, as well as one of a second type.

First, FIG. 3 schematically shows a contact lever holder. 25, which includes a central part A and mounting arms 18, attached thereto on both sides. Central part A includes a base body 26. Base body 26 is designed as a standard component, preferably having the smallest dimensions occurring in a series of low-voltage circuit breakers. The contact lever holders for sizes with higher rated currents are produced by adding additional bodies of a given type to standard base body 26. As an example, FIG. 4 shows a contact lever holder 27, whose central part B includes a combination of a base body 26 with additional bodies 28 of a first type attached on both sides. The width available for mounting contact levers 10 is thus increased from a dimension B1 in FIG. 3 to a dimension B2 in FIG. 4. If a second additional body 30 of a second type is provided, a central part C that includes base body 26 with an additional body 28 of the first type and an additional body 30 of the second type results in a contact lever holder 29 with a useful width B3.

Figure 6:
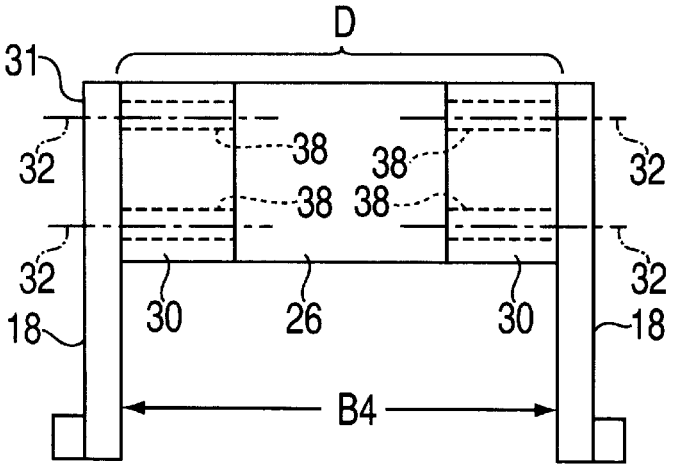
FIG. 6 shows a contact level holder.
Figure 8:
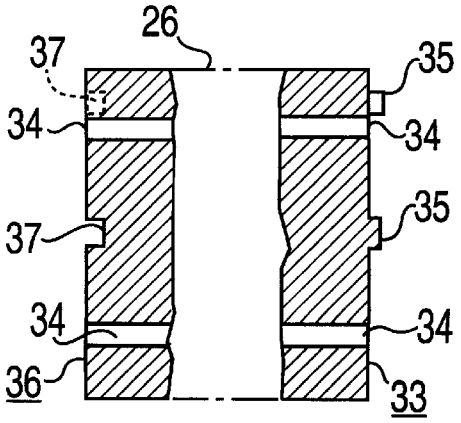
FIG. 8 shows a section VIII—VIII of FIG. 7.

A contact lever holder 31 according to FIG. 6, containing a central part D that includes of a base body 26 with two additional bodies 30 of the second type, has an even larger width B4. Mounting arms 18 are connected to base body 26 or to the central part including base body 26 with additional bodies 28 and 30 using connecting bolts 32, which are illustrated in a simplified manner through their central axes in FIGS. 3, 4, 5, and 6.

Figure 7:
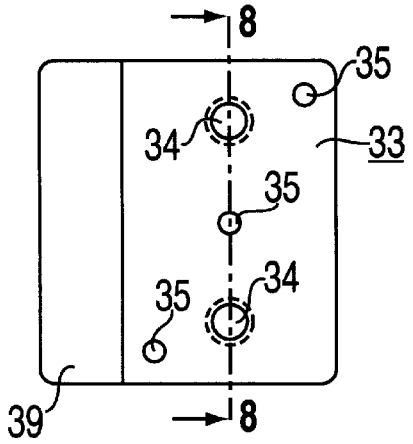
FIG. 7 shows a connecting surface of a base body.

Base body 26 and additional bodies 28 and 30 are provided with connecting surfaces that facilitate joining with the correct dimensions. First, FIG. 7 shows a connecting surface 33 of base body 26 with two threaded holes 34 and three pin-like projections 35, arranged approximately diagonally. The opposite connecting surface 36 contains depressions 37 corresponding to projections 35.

Additional bodies 28 and 30 are provided with connecting surfaces 33 and 36 of the same type, so that base body 26 and additional bodies 28 and 30 can be joined in any desired manner. Additional bodies 28 and 30 contain through holes 38, flush with threaded holes 32, which are indicated in FIGS. 3, 4, 5, and 6.

Base body 26 and additional bodies 28 and 30 can be provided with webs or ribs 39 (FIG. 7) in order to ensure the desired spacing between contact levers 10 (FIG. 2).

What is claimed is:

1. A movable switch contact arrangement for a low-voltage circuit breaker, comprising:

contact levers; and a contact lever holder holding the contact levers, the contact lever holder rotatably mounted for switching on and switching off using lateral mounting arms, the contact lever holder including a central part, the central part having a base body and at least one further body, the at least one further body being formed as a separate part with respect to the base body and being attachable to the base body, the mounting arms being attached to first and second sides of the central part.

2. The movable switch contact arrangement according to claim 1, wherein the base body and the at least one further body have connecting surfaces which have projections and corresponding recesses.

3. The movable switch contact arrangement according to claim 1, wherein each of first and second sides of the base body has at least two threaded holes, the mounting arms and the at least one further body have through holes flush with the threaded holes for receiving connecting bolts.

4. The movable switch contact arrangement according to claim 1, wherein:

the base body has a uniform size;

the at least one further body is provided according to a width of the central part, the width of the central part depending on the number of the contact levers.

* * * * *